US008174480B2

(12) United States Patent
Chen et al.

(10) Patent No.: US 8,174,480 B2
(45) Date of Patent: May 8, 2012

(54) GATE DRIVER AND DISPLAY PANEL UTILIZING THE SAME

(75) Inventors: Chih-Wei Chen, Tainan County (TW); Han-Shui Hsueh, Tainan County (TW)

(73) Assignee: Himax Technologies Limited, Sinshih Township, Tainan County (TW)

( * ) Notice: Subject to any disclaimer, the term of this patent is extended or adjusted under 35 U.S.C. 154(b) by 953 days.

(21) Appl. No.: 12/137,596

(22) Filed: Jun. 12, 2008

(65) Prior Publication Data

US 2009/0309820 A1 Dec. 17, 2009

(51) Int. Cl.
*G09G 3/36* (2006.01)

(52) U.S. Cl. ..... 345/100; 327/333; 361/90; 257/207

(58) Field of Classification Search ..... 345/87, 345/89, 96, 98, 99, 100, 104, 204, 211, 212; 326/63, 68, 81; 327/112, 333; 361/90, 91.1; 257/207

See application file for complete search history.

(56) References Cited

U.S. PATENT DOCUMENTS

| | | | | |
|---|---|---|---|---|
| 4,841,348 | A * | 6/1989 | Shizukuishi et al. | 257/226 |
| 5,412,397 | A * | 5/1995 | Kanatani et al. | 345/99 |
| 5,432,529 | A * | 7/1995 | Azuhata | 345/100 |
| 5,598,180 | A * | 1/1997 | Suzuki et al. | 345/100 |
| 6,052,103 | A * | 4/2000 | Fujiwara et al. | 345/89 |
| 6,473,282 | B1 * | 10/2002 | Lin et al. | 361/90 |
| 6,545,521 | B2 * | 4/2003 | Dale et al. | 327/333 |
| 6,552,709 | B1 * | 4/2003 | Yamaguchi | 345/99 |
| 6,785,107 | B1 * | 8/2004 | Schmitt | 361/91.1 |
| 7,184,010 | B2 * | 2/2007 | Aoki et al. | 345/99 |
| 7,443,374 | B2 * | 10/2008 | Hudson | 345/98 |
| 7,724,232 | B2 * | 5/2010 | Moon | 345/100 |
| 2004/0189584 | A1 * | 9/2004 | Moon | 345/100 |
| 2004/0262643 | A1 * | 12/2004 | Voldman | 257/207 |

FOREIGN PATENT DOCUMENTS

| | | | |
|---|---|---|---|
| JP | 11143432 | A * | 5/1999 |
| JP | 2004199066 | A * | 7/2004 |

OTHER PUBLICATIONS

Motorola Inc, Semiconductor Data Library—CMOS, 1976, Third Edition, p. 5-120.*

* cited by examiner

*Primary Examiner* — Sumati Lefkowitz
*Assistant Examiner* — Jose Soto Lopez
(74) *Attorney, Agent, or Firm* — Thomas|Kayden

(57) ABSTRACT

A gate driver including a shift register, a level shifter, an output buffer, and a processing unit. The shift register generates a shifted signal. The level shifter generates a level signal according to a first operation voltage, a second operation voltage and the shifted signal. The output buffer provides a scan signal according to the level signal. The processing unit controls the level signal to follow the second operation voltage when the first operation voltage equals to a first preset value and the second operation voltage is higher than a second preset value less than the first preset value.

18 Claims, 6 Drawing Sheets

GATE DRIVER AND DISPLAY PANEL UTILIZING THE SAME

BACKGROUND OF THE INVENTION

1. Field of the Invention

The invention relates to a gate driver, and more particularly to a gate driver for a display panel.

2. Description of the Related Art

Because cathode ray tubes (CRTs) are inexpensive and provide high definition, they are utilized extensively in televisions and computers. With technological development, new flat-panel displays are continually being developed. When a larger display panel is required, the weight of the flat-panel display does not substantially change when compared to CRT displays. Generally, flat-panel displays comprises liquid crystal displays (LCD), plasma display panels (PDP), field emission displays (FED), and electroluminescent (EL) displays.

The inversions of the LCD comprise a frame inversion, a line inversion, a column inversion and a dot inversion. The LCD comprises a gate driver. The gate driver receives voltages $V_{DD}$, $V_{SS}$, $V_{GH}$ and $V_{EE}$ and generates scan signals to pixels. Thus, the LCD is capable of displaying images.

FIG. 1A shows a timing chart of the voltages $V_{DD}$, $V_{SS}$, $V_{GH}$ and $V_{EE}$. Generally, the voltage $V_{EE}$ is asserted before the voltage $V_{GH}$. As shown in FIG. 1B, if the voltage $V_{GH}$ is asserted before the voltage $V_{EE}$, the gate driver may generate the abnormal scan signals to the pixels.

BRIEF SUMMARY OF THE INVENTION

Gate drivers are provided. An exemplary embodiment of a gate driver comprises a shift register, a level shifter, an output buffer, and a processing unit. The shift register generates a shifted signal. The level shifter generates a level signal according to a first operation voltage, a second operation voltage and the shifted signal. The output buffer provides a scan signal according to the level signal. The processing unit controls the level signal to follow the second operation voltage when the first operation voltage equals to a first preset value and the second operation voltage is higher than a second preset value less than the first preset value.

Display panels are also provided. An exemplary embodiment of a display panel comprises a gate driver, a source driver, and a display region. The gate driver provides at least one scan signal to at least one gate electrode and comprises a shift register, a level shifter, an output buffer, and a processing unit. The shift register generates a shifted signal. The level shifter generates a level signal according to a first operation voltage, a second operation voltage and the shifted signal. The output buffer provides a scan signal according to the level signal. The processing unit controls the level signal to follow the second operation voltage when the first operation voltage equals to a first preset value and the second operation voltage is higher than a second preset value less than the first preset value. The source driver provides at least one data signal to at least one source electrode. The display region receives the data signal according to the scan signal and displays an image according to the data signal.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
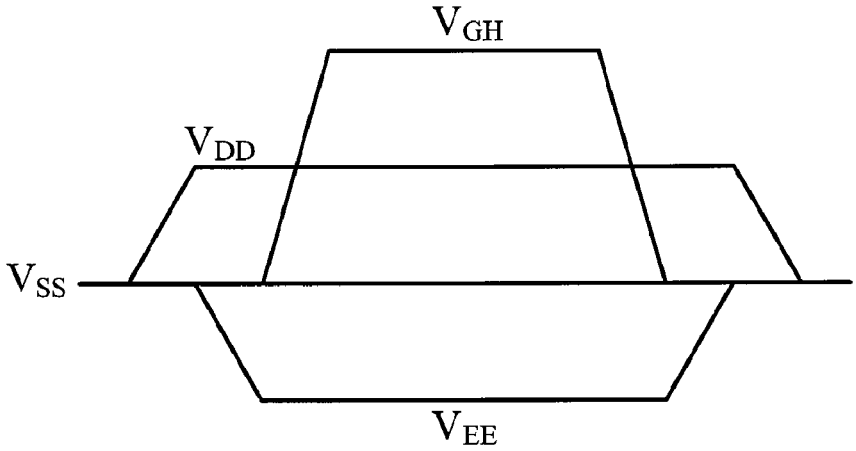
FIGS. 1A and 1B show the voltages $V_{DD}$, $V_{SS}$, $V_{GH}$ and $V_{EE}$.
Figure 1B:
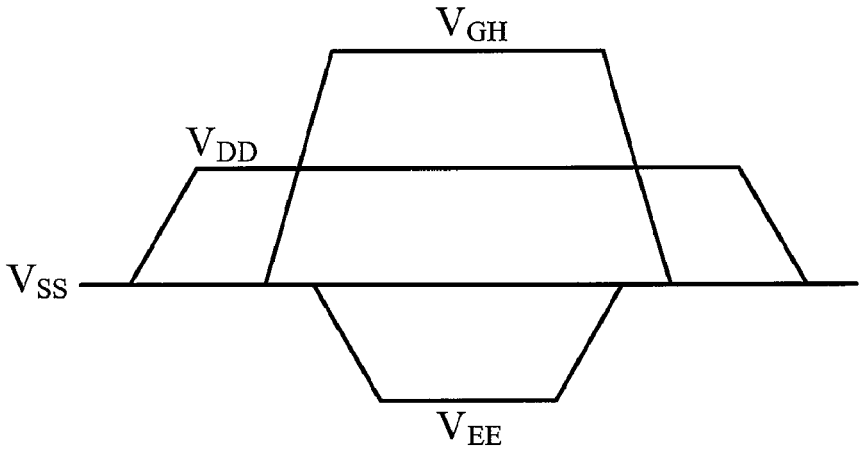
Figure 2:
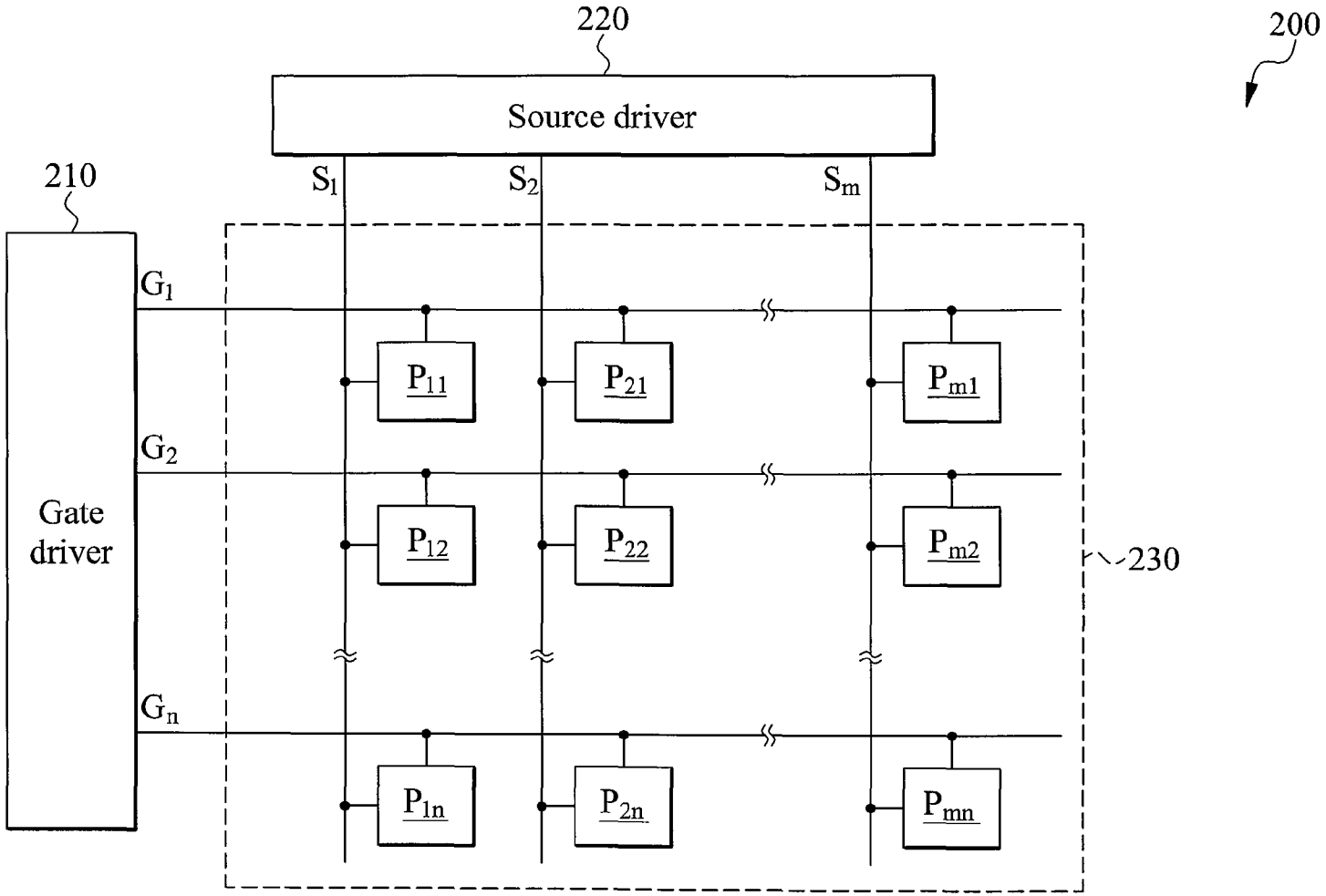
FIG. 2 is a schematic diagram of an exemplary embodiment of a display panel.

FIG. 2 is a schematic diagram of an exemplary embodiment of a display panel. The display panel 200 comprises a gate driver 210, a source driver 220, and a display region 230. The gate driver 210 provides at least one scan signal to at least one gate electrode. The source driver 220 provides at least one data signal to at least one source electrode. The display region 230 receives the data signal according to the scan signal and then displays an image according to the data signal. In this embodiment, the display region 130 comprises pixels $P_{11}$~$P_{mn}$. The pixels $P_{11}$~$P_{mn}$ receive scan signals via gate electrodes $G_1$~$G_n$ and receive the data signals via source electrodes $S_1$~$S_m$.

Figure 3:
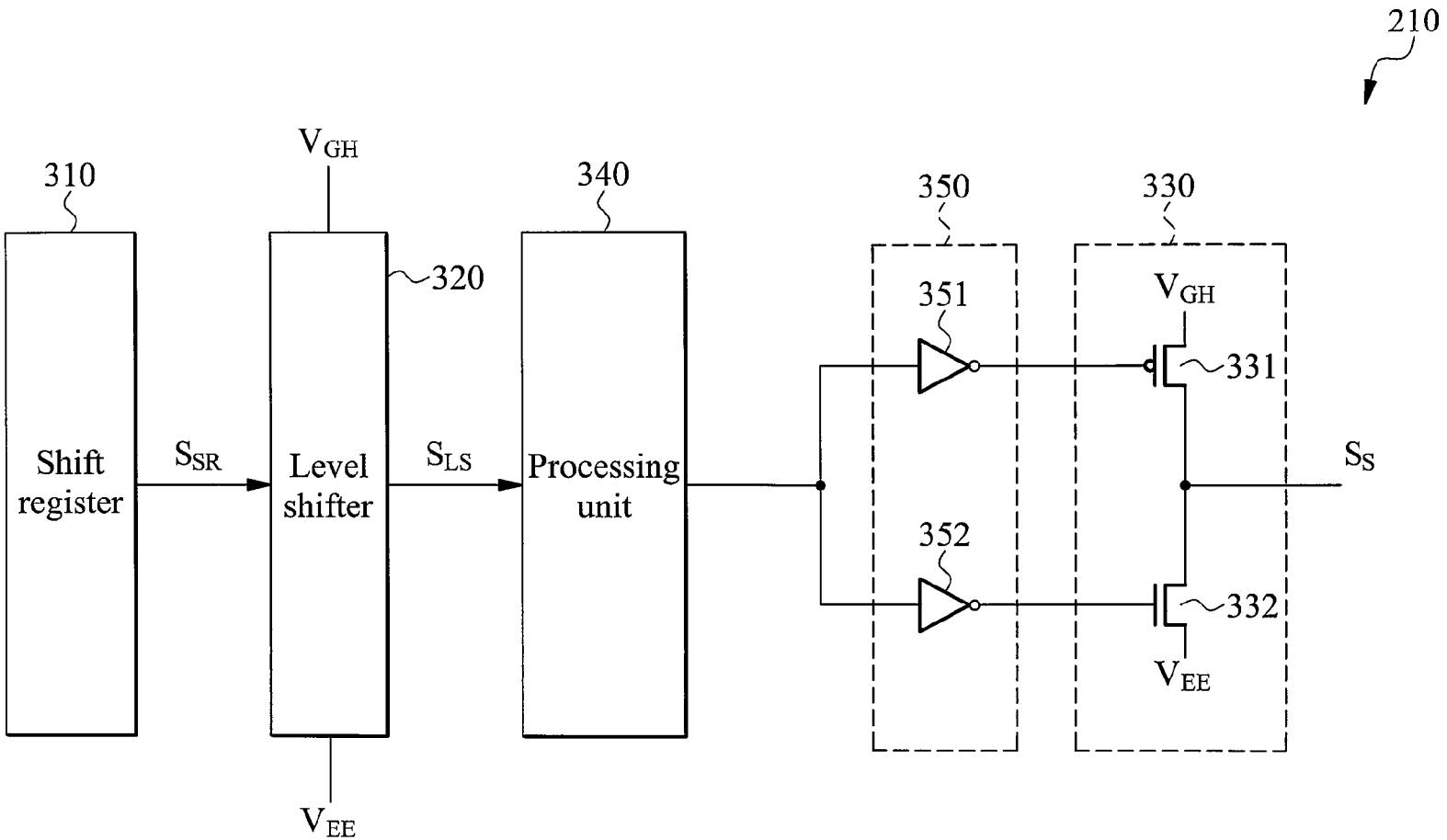
FIG. 3 is a schematic diagram of an exemplary embodiment of the gate driver.

FIG. 3 is a schematic diagram of an exemplary embodiment of the gate driver. The gate driver 210 comprises a shifter register 310, a level shifter 320, an output buffer 330, a processing unit 340, and a transforming unit 350.

The shift register 310 comprises a plurality of cells (not shown). Each cell can provide a shifted signal such that the shift register 310 is capable of providing a plurality of shifted signals. The shifter register is well known to those skilled in the field, thus, description thereof is omitted. For clarity, only one shifted signal $S_{SR}$ is shown and given as an example.

The level shifter 320 provides a level signal $S_{LS}$ according to the operation voltages $V_{GH}$, $V_{EE}$ and the shifted signal $S_{SR}$. In this embodiment, the level shifter 320 transforms the level of the shifted signal $S_{SR}$ to generate the level signal $S_{LS}$. For example, if the shifted signal $S_{SR}$ is at a high level (such as 3.3V), the level of the level signal $S_{LS}$ approximately equals to the operation voltage $V_{GH}$ (such as 20V). If the shifted signal $S_{SR}$ is at a low level (such as 0V), the level of the level signal $S_{LS}$ approximately equals to the operation voltage $V_{EE}$ (such as −5V). In some embodiments, the level shifter 320 may comprise a plurality of level shifting cells (not shown). The level shifting cells respectively receive the shifted signals generated by the cells of the shift register 310 to provide a plurality of level signals. For clarity, only a level signal is shown and given as an example.

The output buffer 330 provides the scan signal $S_S$ according to the level signal $S_{LS}$. As shown in FIG. 3, the output buffer 330 only comprises one stage. In practice, the output buffer 330 comprises a plurality of stages. In this embodiment, the output buffer 330 comprises a P-type transistor 331 and an N-type transistor 332. The P-type transistor 331 connects to the N-type transistor 332 in serial between the voltages $V_{GH}$ and $V_{EE}$. When the operation voltage $V_{GH}$ equal to a first preset value and the operation voltage $V_{EE}$ is higher than a second preset value, the processing unit 340 controls the output buffer 330 such that the N-type transistor 332 is turned on. Thus, the scan signal $S_S$ equals to the operation voltage $V_{EE}$.

As shown in FIG. 3, the transforming unit 350 is coupled between the processing unit 340 and the output buffer 330 to invert the level signal $S_{LS}$. In this embodiment, the transforming unit 350 comprises inverters 351 and 352. The inverters 351 and 352 invert the level signal $S_{LS}$ and transmit the inverted result to the P-type transistor 331 and the N-type transistor 332, respectively. In another embodiment, the transforming unit 350 may comprise an inverter (not shown) to provide the inverted result to the P-type transistor 331 and the N-type transistor 332, simultaneously.

In this embodiment, the processing unit 340 is coupled between the level shifter 320 and the output buffer 330. The processing unit 340 controls the level signal $S_{LS}$ to follow the operation voltage $V_{EE}$ when the operation voltage $V_{GH}$ equals to a first preset value and the operation voltage $V_{EE}$ is higher than a second preset value less than the first preset value. When the operation voltage $V_{GH}$ equals to the first preset value and the operation voltage $V_{EE}$ is less than the second preset value, the processing unit 340 directly transmits the level signal $S_{LS}$ to the output buffer 330.

Figure 4:
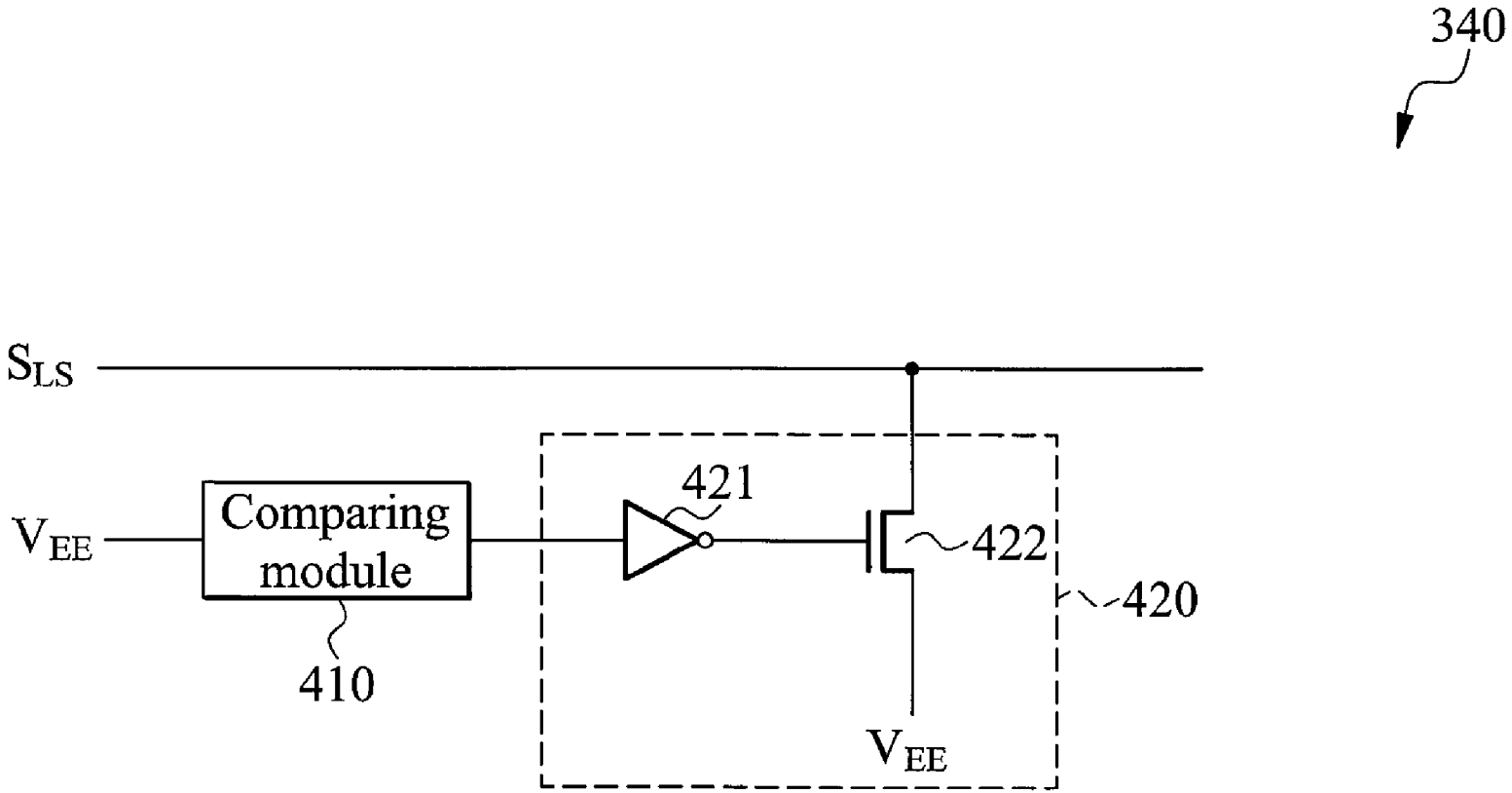
FIG. 4 is a schematic diagram of an exemplary embodiment of the processing unit.

FIG. 4 is a schematic diagram of an exemplary embodiment of the processing unit. The processing unit 340 comprises a comparing module 410 and a switch module 420. The comparing module 410 compares the operation voltage $V_{EE}$ with a second preset value (such as −0.5V). The switch module 420 provides the operation voltage $V_{EE}$ to serve as the level signal $S_{LS}$ according to the compared result.

In this embodiment, the switch module 420 comprises an inverter 421 and an N-type transistor 422. The inverter 421 inverts the comparing result of the comparing module 410. The N-type transistor 422 comprises a gate coupled to the inverter 421, a source receiving the operation voltage $V_{EE}$ and a drain outputting the operation voltage $V_{EE}$.

For example, when the operation voltage $V_{EE}$ is higher than a second preset value, the comparing module 410 outputs a low level. Thus, the N-type transistor 422 is turned on such that the level signal $S_{LS}$ follows the operation voltage $V_{EE}$. When the operation voltage $V_{EE}$ is less than the second preset value, the comparing module 410 outputs a high level. Thus, the N-type transistor 422 is turned off such that the level signal $S_{LS}$ is directly transmits to the transforming unit 350.

When the operation voltage $V_{GH}$ equal to a first preset value and the operation voltage $V_{EE}$ is higher than a second preset value, the level shifter 520 may generate the abnormal level shift causing a latch-up issue. Thus, the output buffer 330 generates the abnormal scan signal due to the latch-up issue. To solve the latch-up issue, the processing unit 340 controls the level signal $S_{LS}$ to follow the operation voltage $V_{EE}$ when the operation voltage $V_{GH}$ equal to a first preset value and the operation voltage $V_{EE}$ is higher than a second preset value.

Figure 5:
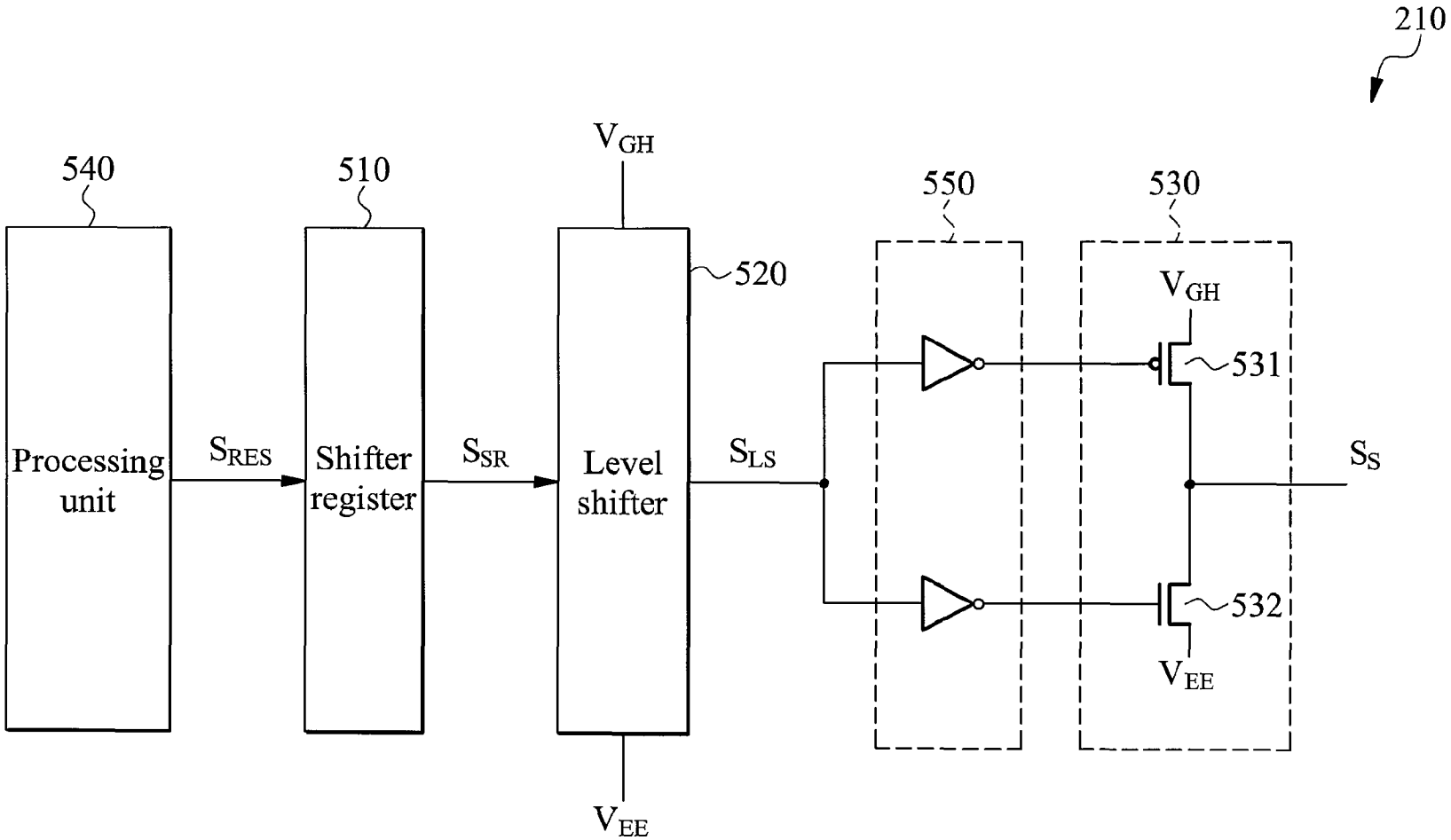
FIG. 5 is a schematic diagram of another exemplary embodiment of the gate driver.

FIG. 5 is a schematic diagram of another exemplary embodiment of the gate driver. The gate driver 210 comprises a shifter register 510, a level shifter 520, an output buffer 530, a processing unit 540, and a transforming unit 550. The shifter register 510, the level shifter 520, the output buffer 530 and the transforming unit 550 are the same as the shift register 310, the level shifter 320, the output buffer 330 and the transforming unit 350 such that the descriptions of the shifter register 510, the level shifter 520, the output buffer 530 and the transforming unit 550 are omitted for brevity.

Figure 6:
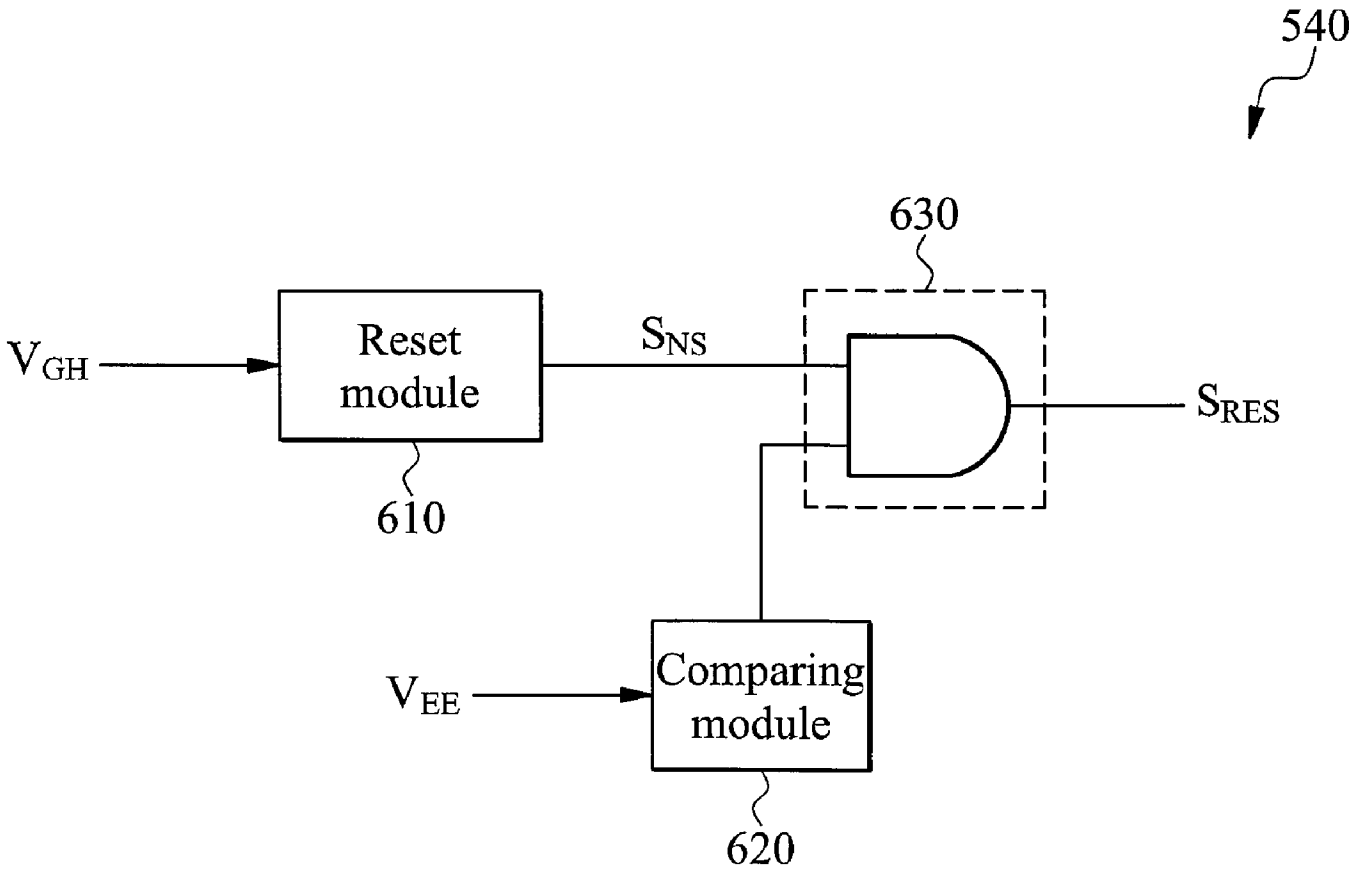
FIG. 6 is a schematic diagram of another exemplary embodiment of the processing unit.

FIG. 6 is a schematic diagram of another exemplary embodiment of the processing unit. The processing unit 540 comprises a reset module 610, a comparing module 620 and a logic module 630. The reset module 610 asserts a notice signal $S_{NS}$ when the operation voltage $V_{GH}$ equals to a first preset value. The comparing module 620 compares the operation voltage $V_{EE}$ with a second preset value. The logic module 630 asserts a reset signal $S_{RES}$ when the operation voltage $V_{EE}$ is less than the second preset value and the operation voltage $V_{GH}$ equals to the first preset value. In this embodiment, the logic module 630 is an AND gate.

When the operation voltage $V_{EE}$ is higher than the second preset value and the operation voltage $V_{GH}$ equals to the first preset value, a latch-up issue may occur in the output buffer 530 such that the output buffer 530 provides the abnormal scan signal. To solve the latch-up issue, when the operation voltage $V_{EE}$ is higher than the second preset value and the operation voltage $V_{GH}$ equals to the first preset value, the reset signal $S_{RES}$ is asserted to reset the shifter register 510. Thus, the level signal $Sy_s$ to follow the operation voltage $V_{EE}$ such that the latch-up issue does not occur in the output buffer 530. When the operation voltage $V_{EE}$ is less than the second preset value and the operation voltage $V_{GH}$ equals to the first preset value, the reset signal $S_{RES}$ is un-asserted. Thus, the shifter register 510 starts generating the shifted signal SsR and the output buffer 530 normally provides the scan signal $S_s$.

While the invention has been described by way of example and in terms of the preferred embodiments, it is to be understood that the invention is not limited to the disclosed embodiments. To the contrary, it is intended to cover various modifications and similar arrangements (as would be apparent to thoses skilled in the art). Therefore, the scope of the appended claims should be accorded the broadest interpretation so as to encompass all such modifications and similar arrangements.

What is claimed is:

1. A gate driver, comprising:

a shift register generating a shifted signal ($S_{SR}$);

a level shifter generating a level signal ($S_{LS}$) according to a first operation voltage ($V_{GH}$), a second operation voltage ($V_{EE}$) and the shifted signal ($S_{SR}$);

an output buffer providing a scan signal ($S_S$) according to the level signal ($S_{LS}$); and a processing unit controlling the level signal ($S_{LS}$) to follow the second operation voltage ($V_{EE}$) when the first operation voltage ($V_{GH}$) equals to a first preset value and the second operation voltage ($V_{EE}$) is higher than a second preset value, wherein the second preset value is less than the first preset value, wherein the processing unit comprises:

a comparing module comparing the second operation voltage ($V_{EE}$) with the second preset value; and a switch module providing the second operation voltage ($V_{EE}$) to serve as the level signal ($S_{LS}$) according to the compared result.

2. The gate driver as claimed in claim 1, wherein the switch module comprises:

an inverter inverting the compared result; and an N-type transistor having a gate coupled to the inverter, a source receiving the second operation voltage ($V_{EE}$) and a drain outputting the second operation voltage ($V_{EE}$).

3. The gate driver as claimed in claim 1, wherein the output buffer comprises:

a P-type transistor; and an N-type transistor connected to the P-type transistor in serial between the first operation voltage ($V_{GH}$) and the second operation voltage ($V_{EE}$).

4. The gate driver as claimed in claim 3, wherein the N-type transistor is turned on when the second operation voltage ($V_{EE}$) is higher than the second preset value.

5. The gate driver as claimed in claim 4, further comprising a transforming unit coupled between the processing unit and the output buffer.

6. The gate driver as claimed in claim 5, wherein the transforming unit comprises:

a first inverter coupled between the switch module and a gate of the P-type transistor; and a second inverter coupled between the switch module and a gate of the N-type transistor.

7. A gate driver, comprising:

a shift register generating a shifted signal ($S_{SR}$);

a level shifter generating a level signal ($S_{LS}$) according to a first operation voltage ($V_{GH}$), a second operation voltage ($V_{EE}$) and the shifted signal ($S_{SR}$);

an output buffer providing a scan signal ($S_S$) according to the level signal ($S_{LS}$); and a processing unit controlling the level signal ($S_{LS}$) to follow the second operation voltage ($V_{EE}$) when the first operation voltage ($V_{GH}$) equals to a first preset value and the second operation voltage ($V_{EE}$) is his her than a second preset value wherein the second preset value is less than the first preset value, wherein the processing unit comprises:

a reset module asserting a notice signal ($S_{NS}$) when the first operation voltage ($V_{GH}$) equals to the first preset value;

a comparing module comparing the second operation ($V_{EE}$) with the second preset value; and a logic module asserting a reset signal ($S_{RES}$) when the first operation voltage ($V_{GH}$) equals to the first preset value and the second operation voltage ($V_{EE}$) is less than the second preset value.

8. The gate driver as claimed in claim 7, further comprising a transforming unit coupled between the level shifter and the output buffer for inverting the level signal ($S_{LS}$), wherein the output buffer comprises a P-type transistor and an N-type transistor connected to the P-type transistor in serial between the first operation voltage ($V_{GH}$) and the second operation voltage ($V_{EE}$).

9. The gate driver as claimed in claim 8, wherein the transforming unit comprises:

a first inverter coupled between the level shifter and a gate of the P-type transistor; and a second inverter coupled between the level shifter and a gate of the N-type transistor.

10. A display panel, comprising:

a gate driver providing at least one scan signal to at least one gate electrode and comprising:

a shift register generating a shifted signal ($S_{SR}$);

a level shifter generating a level signal ($S_{LS}$) according to a first operation voltage ($V_{GH}$), a second operation voltage ($V_{EE}$) and the shifted signal ($S_{SR}$);

an output buffer providing the scan signal ($S_S$) according to the level signal ($S_{LS}$); and a processing unit controlling the level signal ($S_{LS}$) to follow the second operation voltage ($V_{EE}$) when the first operation voltage ($V_{GH}$) equals to a first preset value and the second operation voltage ($V_{EE}$) is higher than a second preset value, wherein the second preset value is less than the first preset value; and a source driver providing at least one data signal to at least one source electrode; and a display region receiving the data signal according to the scan signal and displaying an image according to the data signal, wherein the processing unit comprises:

a comparing module comparing the second operation voltage ($V_{EE}$) with the second preset value; and a switch module providing the second operation voltage ($V_{EE}$) to serve as the level signal ($S_{LS}$) according to the compared result.

11. The display panel as claimed in claim 10, wherein the switch module comprises:

an inverter inverting the compared result; and an N-type transistor having a gate coupled to the inverter , a source receiving the second operation voltage ($V_{EE}$) and a drain outputting the second operation voltage ($V_{EE}$).

12. The display panel as claimed in claim 10, wherein the output buffer comprises:

a P-type transistor; and an N-type transistor connected to the P-type transistor in serial between the first operation voltage ($V_{GH}$) and the second operation voltage ($V_{EE}$).

13. The display panel as claimed in claim 12, wherein the N-type transistor is turned on when the second operation voltage ($V_{EE}$) is higher than the second preset value.

14. The display panel as claimed in claim 13, wherein the gate driver further comprises a transforming unit coupled between the processing unit and the output buffer.

15. The display panel as claimed in claim 14, wherein the transforming unit comprises:

a first inverter coupled between the switch module and a gate of the P-type transistor; and a second inverter coupled between the switch module and a gate of the N-type transistor.

16. A display panel, comprising:

a gate driver providing at least one scan signal to at least one gate electrode and comprising:

a shift register generating a shifted signal ($S_{SR}$);

a level shifter generating a level signal ($S_{LS}$) according to a first operation voltage ($V_{GH}$), a second operation voltage ($V_{EE}$) and the shifted signal ($S_{SR}$);

an output buffer providing the scan signal ($S_S$) according to the level signal ($S_{LS}$); and a processing unit controlling the level signal ($S_{LS}$) to follow the second operation voltage ($V_{EE}$) when the first operation voltage ($V_{GH}$) equals to a first preset value and the second operation voltage ($V_{EE}$) is higher than a second preset value, wherein the second preset value is less than the first preset value; and a source driver providing at least one data signal to at least one source electrode; and a display region receiving the data signal according to the scan signal and displaying an image according to the data signal, wherein the processing unit comprises:

a reset module asserting a notice signal ($S_{NS}$) when the first operation voltage ($V_{GH}$) equals to the first preset value;

a comparing module comparing the second operation voltage ($V_{EE}$) with the second preset value; and a logic module asserting a reset signal ($S_{RES}$) when the first operation voltage ($V_{GH}$) equals to the first preset value and the second operation voltage ($V_{EE}$) is less than the second preset value.

17. The display panel as claimed in claim 16, wherein the gate driver further comprises a transforming unit coupled between the level shifter and the output buffer for inverting the level signal ($S_{LS}$), wherein the output buffer comprises a P-type transistor and an N-type transistor connected to the P-type transistor in serial between the first operation voltage ($V_{GH}$) and the second operation voltage ($V_{EE}$).

18. The display panel as claimed in claim 17, wherein the transforming unit comprises:

a first inverter coupled between the level shifter and a gate of the P-type transistor; and a second inverter coupled between the level shifter and a gate of the N-type transistor.

* * * * *